US006840828B1

(12) United States Patent
Higby

(10) Patent No.: US 6,840,828 B1
(45) Date of Patent: Jan. 11, 2005

(54) EXPANDABLE RETAINING RING ASSEMBLY

(75) Inventor: Jeffrey P. Higby, Grayslake, IL (US)

(73) Assignee: Bombardier Recreational Products Inc, Valcourt (CA)

( * ) Notice: Subject to any disclaimer, the term of this patent is extended or adjusted under 35 U.S.C. 154(b) by 0 days.

(21) Appl. No.: 10/249,055

(22) Filed: Mar. 12, 2003

Related U.S. Application Data

(60) Provisional application No. 60/363,367, filed on Mar. 12, 2002.

(51) Int. Cl.[7] ..... B63H 23/34
(52) U.S. Cl. ..... 440/83; 440/78
(58) Field of Search ..... 440/78, 83; 384/903

(56) References Cited

U.S. PATENT DOCUMENTS 4,136,989 A * 1/1979 Bianco ..... 403/261
6,132,101 A * 10/2000 Landy, III ..... 384/559

* cited by examiner

*Primary Examiner*—Ed Swinehart
(74) *Attorney, Agent, or Firm*—BRP Legal Services

(57) ABSTRACT

A retaining ring assembly and method of assembly is disclosed. A gearcase includes a propeller shaft housing that is retained in the gearcase. The propeller shaft housing is secured against rotational, radial, and axial movement by a retainer. The retainer has a general circular shape and includes a first ring and a second ring. Both rings include a plurality of collinear threaded holes. Threaded fasteners secure the first ring to the second ring via the threaded holes in each respective ring. The first ring has a tapered surface that engages with a tapered surface of the propeller shaft housing. The second ring has an outer diameter that engages with an annular groove on an inner surface of the gearcase. As the threaded fasteners of the retainer are tightened, the tapered face of the first ring is forced against the tapered face of the propeller shaft housing while the second ring is retained in position by the annular groove of the gearcase. Tightening the threaded fasteners creates, and gradually increases, a gap between the first and second rings. This construction secures the propeller shaft housing in the gearcase.

27 Claims, 7 Drawing Sheets

EXPANDABLE RETAINING RING ASSEMBLY

CROSS REFERENCE TO RELATED APPLICATIONS

The present application claims the priority of U.S. Provisional Application Ser. No. 60/363,367, filed Mar. 12, 2002 and entitled PROPELLER SHAFR HOUSING RETENTION SYSTEM.

BACKGROUND OF INVENTION

The present invention relates generally to expandable retaining rings and, more particularly, relates to a method and apparatus for retaining a propeller shaft housing in a gearcase of an outboard motor.

In order to ensure proper operation of the outboard motor, a propeller shaft housing must be secured within a gearcase. The propeller shaft housing should be secured against rotational, axial, and radial movement. In securing the propeller shaft housing in the gearcase, it is important to maintain a concentric orientation between the gearcase and the propeller shaft housing for proper mechanical operation of the outboard motor.

Outboard motors often incorporate an exhaust passage through the gearcase. This exhaust passage exhausts gases from the outboard motor under the surface of the water so that these gases are not exhausted in the vicinity of persons using the vessel. This method of discharging engine exhaust below the surface of the water also muffles engine noises that are common to all exhaust systems, not only marine systems. It is well known that engine efficiency is a function of exhaust parameters. As such, any unnecessary restriction of the exhaust can negatively affect the efficiency of the engine.

Outboard motors also need to be very durable. These motors can be operated in both salt water and fresh water. Any portion of the motor exposed to these atmospheres needs to be durable and debris and corrosion resistant. In particular, the propeller shaft housing needs to be securely fixed within the gearcase by a means that meets these requirements. The propeller shaft housing is often used to separate the gearcase into two distinct sections. The first section contains the gears of the system. It is generally desirable that this area of the gearcase not be exposed to the exhaust and cooling flows discussed above. The second section of the gearcase is that section that is exposed to the cooling and exhaust flows. Somewhere in this second section is the means of securing the propeller shaft housing in the gearcase. Maintaining the isolation between the first and second sections of the gearcase is important to the operability and life expectancy of the outboard motor. The retainer that secures the propeller shaft housing in the gearcase can help extend the life of the motor in a number of respects, one of which is accurate centering of the propeller shaft in the propeller shaft housing.

Additionally, since outboard motors flow through water, it is most advantageous to provide a smooth hydrodynamic surface to flow therethrough. This flow of water over the gearcase can create unwanted drag on the motor if the housing has protrusions thereon that will decrease the overall efficiency of the motor. A means of securing the propeller shaft housing in/to the gearcase should maintain a minimal profile to minimize hydrodynamic losses associated with the water flow over the gearcase.

There are several known methods of retaining the propeller shaft housing in the gearcase. One such method includes a flange located on a rear facing end of the propeller shaft housing. Fasteners secure the flange of the propeller shaft housing to the gearcase. This method introduces discontinuities on the outer surface of the gearcase which increase hydrodynamic losses. Additionally, the concentricity of the gearcase to the propeller shaft housing is dependent on the mating diameters of the gearcase and the propeller shaft housing.

A second method includes using an externally threaded ring. The threaded ring has a matching thread on an inside surface of the gearcase. The ring is threaded into the gearcase and applies a compression load to the propeller shaft housing thereby seating the housing against a shoulder in the front of the gearcase. This method is prone to damage of the threaded surfaces between the ring and the gearcase during routine maintenance and assembly. Additionally, due to the large diameter of the thread, reasonable tightening torques result in limited and inconsistent compression load on the propeller shaft housing, which, when too low, can lead to radial and rotational movement of the propeller shaft housing within the gearcase.

A third method includes a pair of tabs that are attached to the rear of the propeller shaft housing. These tabs extend beyond an outer diameter of the propeller shaft housing and have an end that is inserted into a corresponding recess in an inside wall of the gearcase. After the propeller shaft housing is positioned in the gearcase, the tabs are inserted into the recesses in the gearcase at a slight angle. As the fasteners that secure the tabs to the propeller shaft housing are tightened, the tabs provide a compressive spring load to the propeller shaft housing thereby securing the propeller shaft housing within the gearcase. The clamp load associated with this method does not totally prevent radial movement at the rear of the propeller shaft housing. This radial movement leads to wear of the mating components of the gearcase and prop shaft housing and can ultimately lead to gearcase assembly failure. A wedge is often disposed between the propeller shaft housing and the inside surface of the gearcase in an effort to prevent wear associated with this radial movement. Implementing this wedge not only increases assembly and production costs but detrimentally affects the concentricity of the propeller shaft housing to the gearcase by biasing the propeller shaft housing away from the wedge and towards an opposite side of the gearcase.

Another method of securing a propeller shaft housing includes positioning a snap ring in a groove in an inside surface of the gearcase in front of the propeller shaft housing. The propeller shaft housing includes a plurality of screws that pass through the front of the propeller shaft housing and into a plate. As the screws are drawn tight, the steel plate is drawn to a front side of the snap ring and the propeller shaft housing is drawn to a shoulder on the inner surface of the gearcase. This method does not secure the rear of the propeller shaft housing and allows for the same type of radial movement of the propeller shaft housing as discussed above, resulting in early failure.

Other methods for retaining a propeller shaft housing within a gearcase are known in the art, but all suffer one or more of the aforementioned shortcomings. It would therefore be desirable to have an apparatus and method capable of securing a propeller shaft housing in a gearcase such that the propeller shaft housing is maintained in a fixed, concentric relationship to the gearcase. It would also be desirable, in securing the propeller shaft housing in the gearcase, to not unduly restrict fluid flow over the gearcase nor restrict engine exhaust flow therethrough.

SUMMARY OF INVENTION

The present invention provides an apparatus and method of securing a propeller shaft housing that solves the aforementioned problems.

A retaining ring assembly of a gearcase of an outboard motor is disclosed. A propeller shaft housing is located in the gearcase. A front surface of the propeller shaft housing meets a shoulder formed on an inside surface of the gearcase. A retaining ring assembly includes a first ring and a second ring. Each ring includes a plurality of threaded holes while neither ring forms a complete circle. The retaining ring assembly is radially compressible and axially expandable. The retaining ring secures the propeller shaft housing in the gearcase and does not substantially interfere with the flow of water over the gearcase or the flow of exhaust gases through the gearcase.

In accordance with one aspect of the present invention, a retainer includes a first ring and a second ring. The first ring is constructed to expand radially outward. The second ring is removably connected to the first ring. A fastener system independently connects the first ring to the second ring and provides expansion therebetween.

In accordance with another aspect of the present invention, an outboard motor is disclosed. The outboard motor comprises a housing, an engine located in the housing, and a gearcase attached to the housing below the engine. A propeller shaft housing is positioned in the gearcase and supports a propeller shaft that extends therethrough. A retention ring assembly is situated in a rearward portion of the gearcase and abuts against the propeller shaft housing. The retention ring assembly is axially expandable to secure the propeller shaft housing in the gearcase.

In accordance with another aspect of the present invention, a gearcase is disclosed. The gearcase has a center bore with a front end and a rear end. The gearcase has a shoulder in a perimeter of the front end of the center bore and an annular groove in the perimeter of the rear end of the center bore. A propeller shaft housing having a rear outer diameter is positioned in the gearcase between the shoulder and the annular groove. A first C-shaped ring is engaged with the rear outer diameter of the propeller shaft housing. A second C-shaped ring is expandably secured to the first C-shaped ring and engaged with the annular groove of the gearcase.

In accordance with yet another aspect of the present invention, a method of assembling a gearcase is disclosed. The method includes attaching a first ring to a second ring via a plurality of screws to form a retention ring assembly. A propeller shaft is then inserted into a gearcase. The retention ring assembly is then compressed and inserted into the gearcase. The compression of the retention ring assembly is then released. The plurality of screws is then tightened to force the first ring away from the second ring and into engagement with the propeller shaft housing.

In accordance with a final aspect of the present invention, a retainer comprises a first and a second ring. The retainer includes a means for attaching the first ring to the second ring and expanding the first ring away from the second ring and having the attached rings radially expandable.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
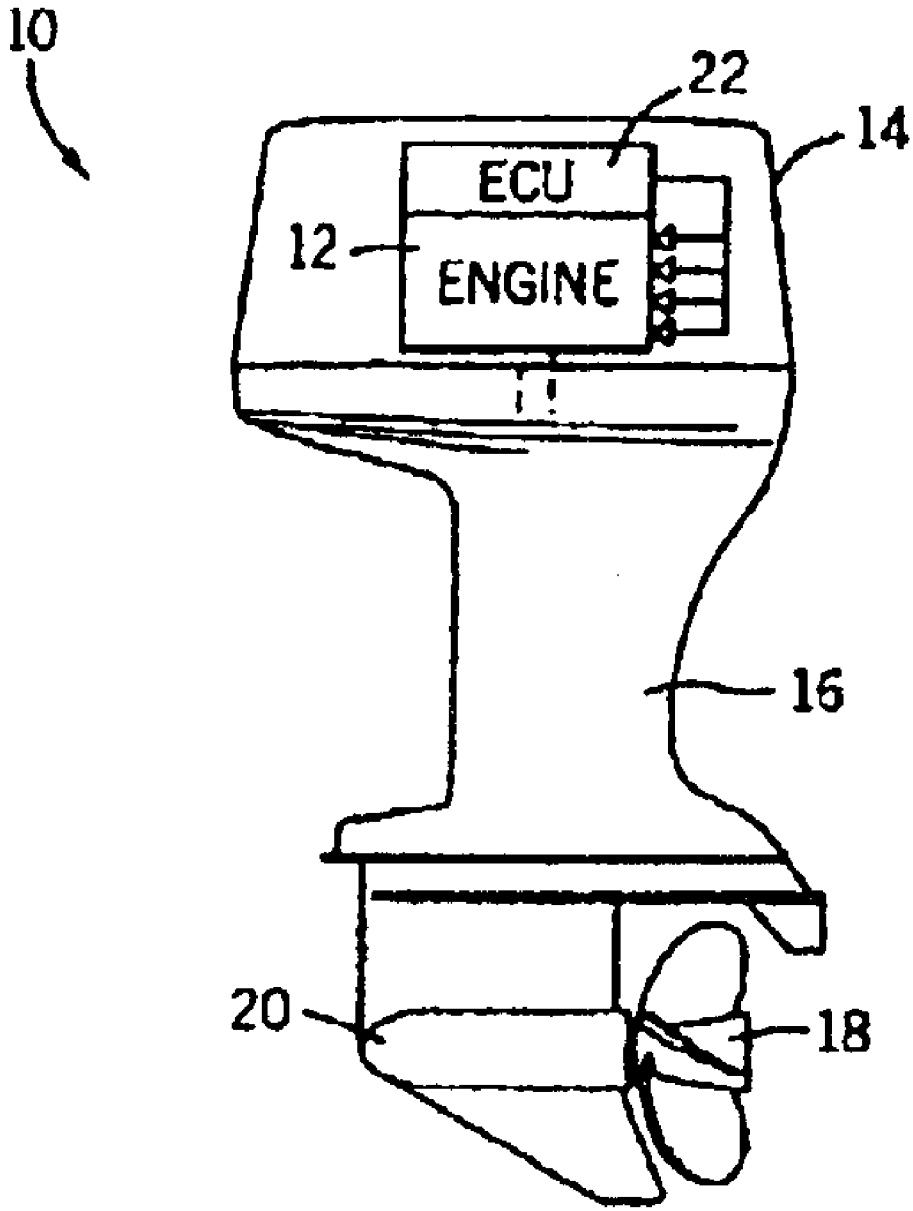
FIG. 1 is an outboard marine engine incorporating the present invention.

The present invention relates to retaining rings and, more particularly, relates to a method and apparatus for retaining a propeller shaft housing in a gearcase of an outboard marine engine. FIG. 1 shows an outboard motor 10 having an engine 12 housed in a powerhead 14 and supported on a mid-section 16 configured for mounting on the transom of a boat (not shown) in a known conventional manner. An output shaft of engine 12 is coupled to drive a propeller 18 extending rearwardly of a lower gearcase 20 via the mid-section 16. The engine 12 is controlled by an electronic control unit (ECU) 22. While the present invention is shown in FIG. 1 as being incorporated into an outboard motor, the present invention is equally applicable with many other applications, some of which include personal watercrafts, and watercraft powered by inboard engines.

Figure 2:
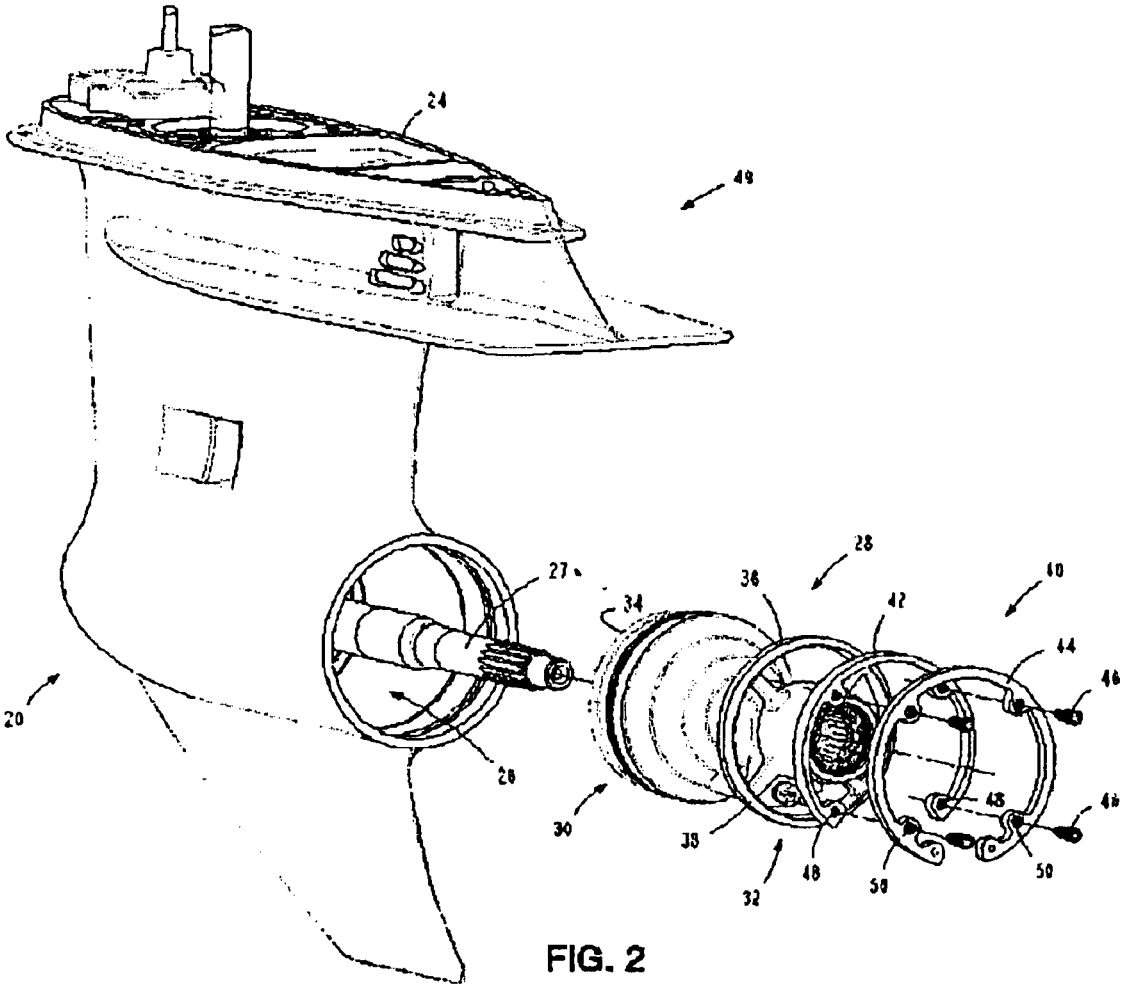
FIG. 2 is an exploded perspective view of a gearcase assembly of the marine engine shown in FIG. 1.
Figure 9:
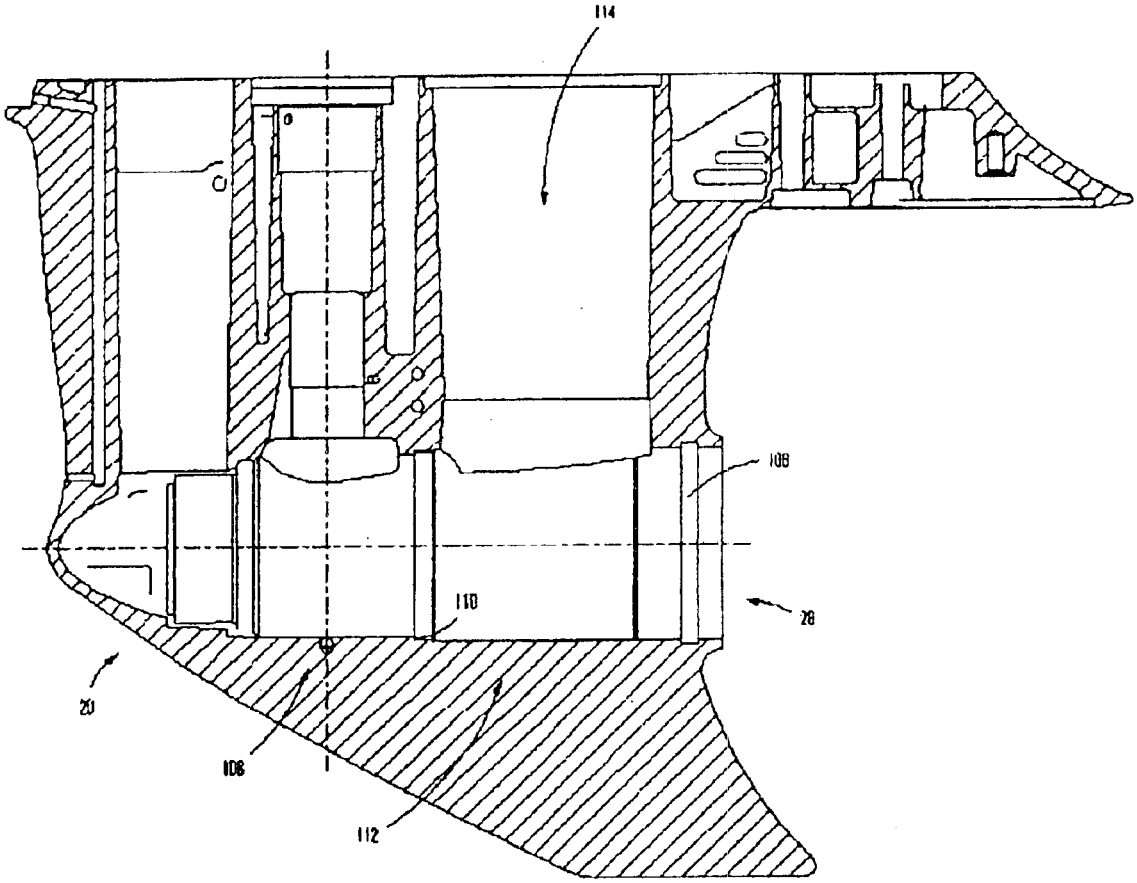
FIG. 9 is a side cross-sectional view of the gearcase shown in FIG. 2.

FIG. 2 shows an exploded view of the contents of lower gearcase 20. Lower gearcase 20 is mounted to midsection 16 by a flange 24. Extending from a center bore 26 of lower gearcase 20 is a horizontally arranged propeller shaft 27. A propeller shaft housing 28 is constructed to fit over propeller shaft 27 in center bore 26 of gearcase 20. Propeller shaft housing 28 has a front section 30 and a rear section 32. Front section 30 has an outer edge 34 constructed to engage a shoulder (as will be described with reference to FIG. 9) of center bore 26 of lower gearcase 20. Rear section 32 of propeller shaft housing 28 has an outer edge 36 sized to fit in center bore 26 of lower gearcase 20. Rear section 32 of propeller shaft housing 28 also includes a tapered face 38 rearwardly facing. Tapered face 38 is constructed to engage a first ring 42 of a retention ring assembly 40. Retention ring assembly 40 includes first ring 42, a second ring 44, and a plurality of fasteners 46. First ring 42 and second ring 44 each have a plurality of threaded holes 48, 50. Fasteners 46 engage threaded holes 48 of first ring 42 and threaded holes 50 of second ring 44. Retention ring assembly 40 secures propeller shaft housing 28 concentrically in center bore 26 of lower gearcase 20 to form a lower unit assembly 49. When lower unit assembly 49 is attached to the mid-section of the motor, power is transferred from the engine to propeller shaft 27. In order to maintain motor efficiency, propeller shaft housing 28 must withstand the rotational, axial, and radial forces transferred by the propeller shaft 27. Retention ring assembly 40 ensures that propeller shaft housing 28 is concentrically secured in lower gearcase 20.

Figure 3:
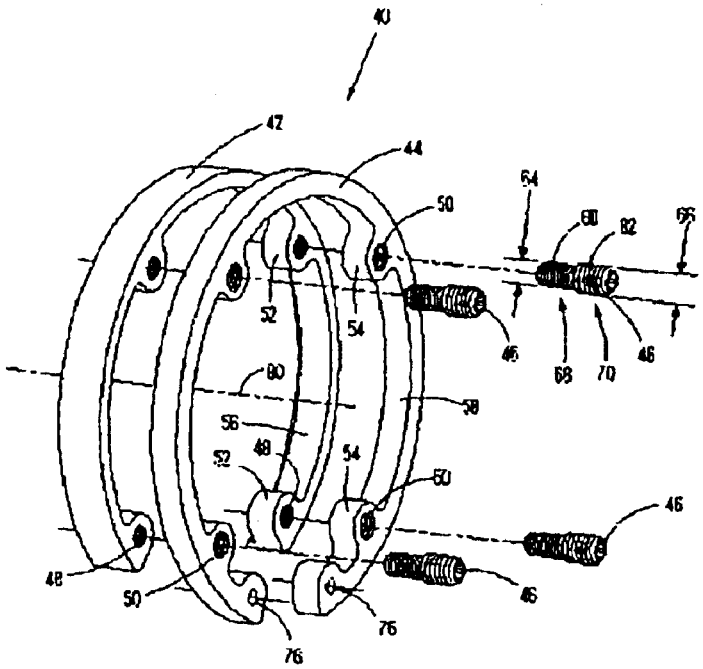
FIG. 3 is an exploded rear perspective view of a retention ring assembly for use in the gearcase of FIG. 2.
Figure 4:
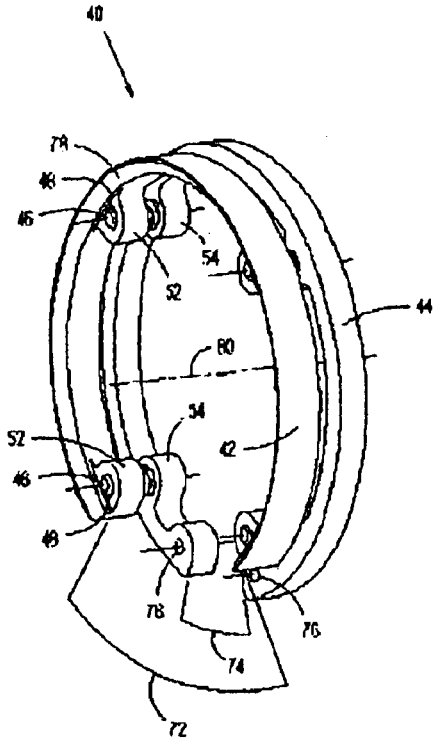
FIG. 4 is a front perspective view of the assembled retention ring assembly shown in FIG. 3.

Retention ring assembly 40 is shown in more detail in FIGS. 3 and 4. Second ring 44 preferably includes four threaded holes 50 that are coaxial to four threaded holes 48 of first ring 42 as best shown in FIG. 4. Threaded holes 48, 50 are located on a plurality of lobes 52, 54 located on an inner diameter 56, 58 of first and second rings 42, 44. Plurality of fasteners 46 connect holes 48 of lobes 52 of the first ring 42 to holes 50 of lobes 54 of second ring 44. In effect, fasteners 46 connect first ring 42 to second ring 44 to form retention ring assembly 40.

Fasteners 46 have a first threaded section 60 and a second threaded section 62. First threaded section 60 has a diameter 64 that is smaller than a diameter 66 of second threaded section 62. Additionally, first threaded section 60 and second threaded section 62 have different thread pitches 68, 70. Thread pitch 68 of first threaded section 60 is preferably finer than thread pitch 70 of second threaded section 62. Threaded holes 48 of first ring 42 are constructed to receive first threaded section 60 of threaded fastener 46 and threaded holes 50 of second ring 44 are constructed to engage second threaded section 62 of threaded fastener 46. First threaded section 60 of fastener 46 is constructed to allow passage through threaded holes 50 of second ring 44 without engaging interference from the threads therein.

Figure 10:
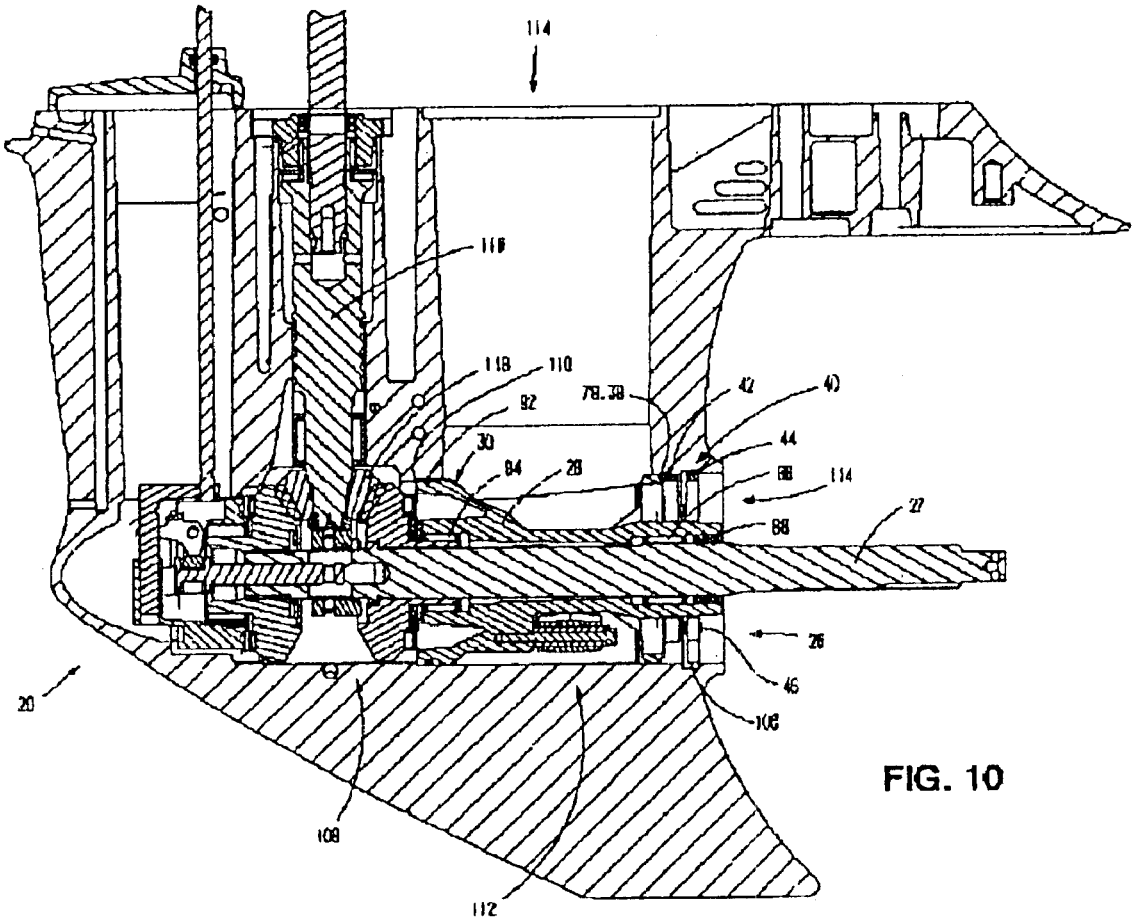
FIG. 10 is a side cross-sectional view of the assembled gearcase assembly shown in FIG. 2.

Referring to FIG. 4, first ring 42 and the second ring 44 include an open section 72, 74 such that both first ring 42 and second ring 44 are C-shaped and expandable radially. First ring 42 is attached to second ring 44 such that first ring open section 72 is aligned with second ring open section 74. Second ring 44 includes a pair of holes 76 that are preferably not threaded. The pair of holes 76, along with the alignment of open sections 72, 74, allow for radial compression of retention ring assembly 40 through use of a snap-ring pliers. First ring 42 includes a tapered face 78 that faces away from second ring 44 and is tapered toward a central axis 80 of second ring 44 of retention ring assembly 40. Tapered face 78 is configured to engage tapered surface 38 of the propeller shaft housing 28 as is shown in FIG. 10.

Figure 5:
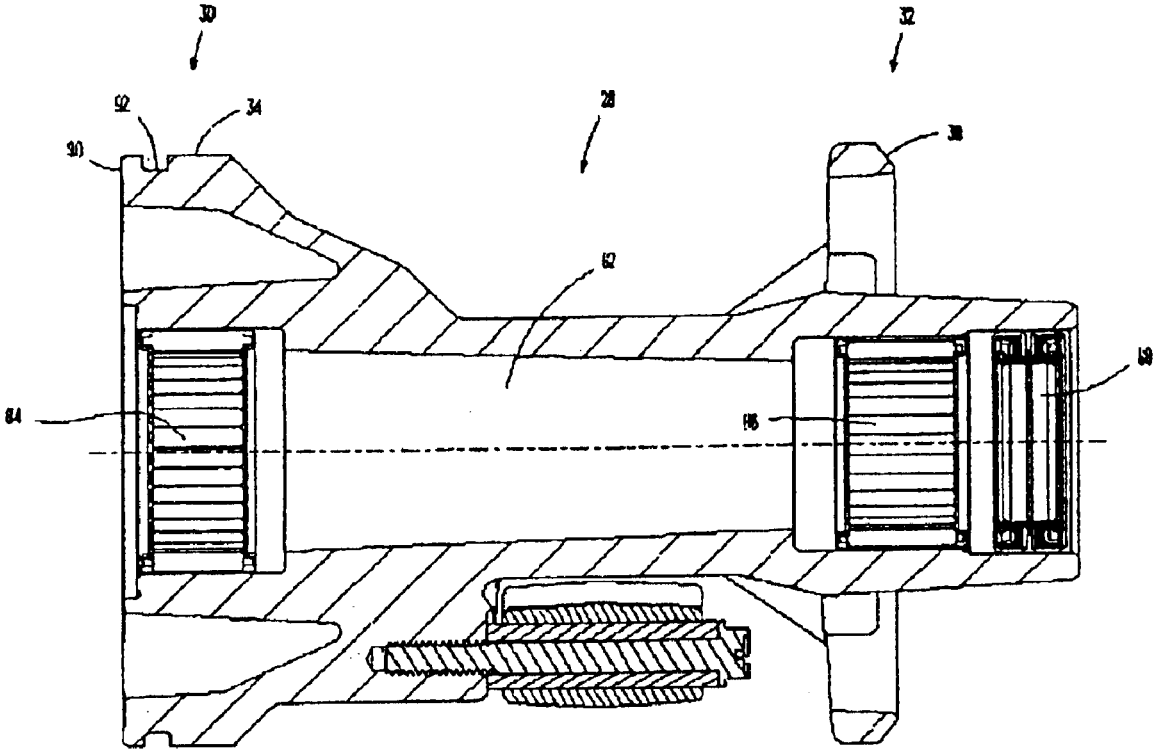
FIG. 5 is a side cross-sectional view of the propeller shaft housing shown in FIG. 2.

In FIG. 5, tapered face 38 of propeller shaft housing 28 is configured to engage the tapered face of first ring 42. Propeller shaft housing 28 includes an inner section 82 that allows passage of a propeller shaft through the propeller shaft housing 28. Inner section 82 includes a front bearing 84 at front section 30 and a rear bearing 86 at rear section 32. A seal 88 is located in rear section 32 of center section 82 of propeller shaft housing 28. Seal 88 prevents exchange of fluids through inner section 82 of propeller shaft housing 28 when propeller shaft housing 28 is inserted into a gearcase around a propeller shaft. Located on outer edge 34 of front section 30 of propeller shaft housing 28 is an annular seal groove 92, which accepts an o-ring seal, not shown in FIG. 5. Front section 30 of propeller shaft housing 28 also includes a front surface 90 adjacent outer edge 34. Front surface 90 and annular seal groove 92 seal a front section of the gearcase from a rear section of the gearcase when the propeller shaft housing 28 is assembled in the gearcase, the importance of which will be addressed further in reference to FIGS. 9 and 10.

Figure 8:
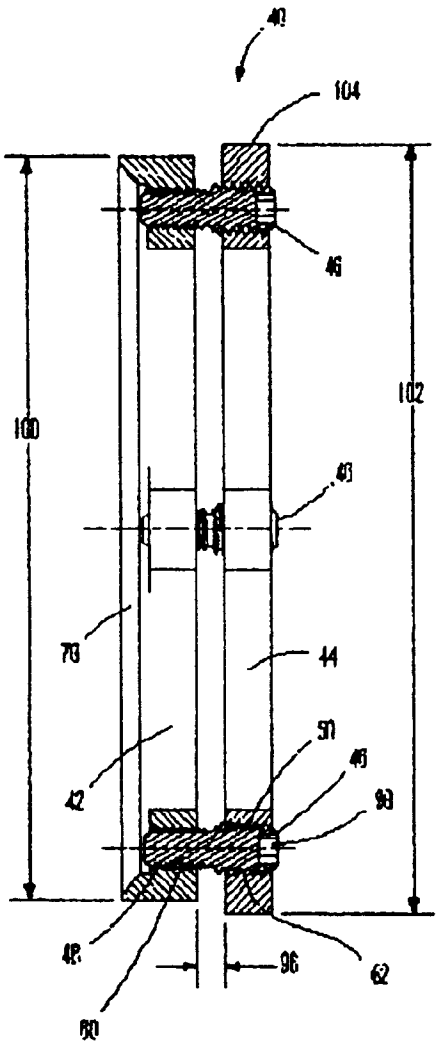
FIG. 8 is a side cross-sectional view of the retention ring assembly shown in FIG. 4 at full axial expansion of the rings.
Figure 7:
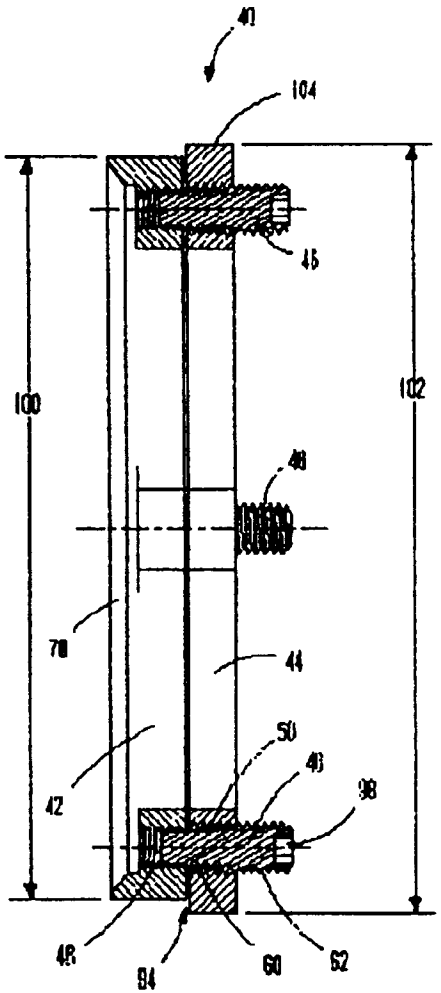
FIG. 7 is a side cross-sectional view of the retention ring assembly shown in FIG. 4 after assembly is initially started.
Figure 6:
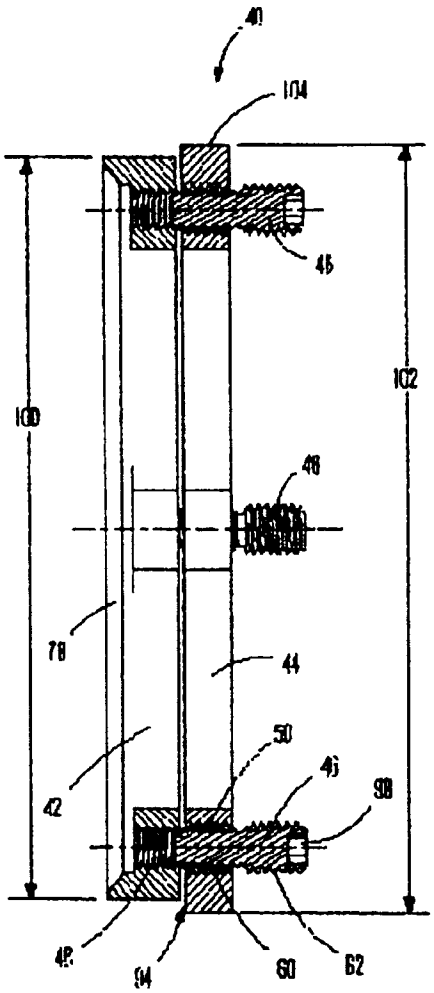
FIG. 6 is a side cross-sectional view of the retention ring assembly shown in FIG. 4 prior to assembly.

FIGS. 6, 7, 8, in combination, show the assembly and operation of retention ring assembly 40. FIG. 6 shows the rings of assembly 40 before assembled together. First threaded section 60 of fastener 46 passes through threaded hole 50 of second ring 44 without engaging interference with the threads therein. First threaded section 60 of fastener 46 engages the threaded hole 48 of first ring 42 prior to the second threaded section 62 engaging threaded hole 50 of second ring 44. For clarity, a gap 94 is shown between first ring 42 and second ring 44 in FIG. 6. It is to be understood that prior to threaded engagement of fastener 46 to both first ring 42 and second ring 44, no such gap is necessary. In FIG. 7, first threaded section 60 of fastener 46 is engaged with threaded holes 48 of first ring 42 and second threaded section 62 of fastener 46 is minimally engaged with threaded holes 50 of second ring 44. Due to a difference in pitch between first threaded section 60 and second threaded section 62 of fastener 46, first ring 42 is axially forced away from second ring 44 as fasteners 46 are tightened thereby increasing gap 94 as measured between first ring 42 and second ring 44, as best shown in FIG. 8. Gap 94 is shown at a maximum distance 96 in FIG. 8 where fasteners 46 are fully engaged with both first ring 42 and second ring 44. Fasters 46 also include a tool recess 98. Although shown as a recess by way of example, it is to be understood there exist a plurality of fastener driving constructions that are contained within the scope of the present invention. Additionally, although inherent in the construction as shown, the threading of the first section 60 and second section 62 are of the same rotational engagement direction, i.e. right or left handed threading. It is understood that several other configurations are envisioned such as a fastener with a first section that has a right hand thread and a second section that has a left hand thread. Such a fastener could be inserted between the first and second rings to begin assembly. Turning these fasteners in the appropriate direction would draw the two rings together prior to installation in the gearcase. Once installed in the gearcase, turning the screws in the opposite direction would cause the two rings to separate, thereby functioning in the same manner as the preferred embodiment. Although not shown, by way of example, such configurations are well within the scope of the present invention as claimed.

Taper 78 of first ring 42 is also shown in FIGS. 6–8. Taper 78 engages rear taper 38 of a propeller shaft housing 28 shown in FIG. 5. Also shown in FIGS. 6–8, a diameter 100 of first ring 42 is smaller than a diameter 102 of second ring 44. Diameter 102 of second ring 44, being greater than diameter 100 of first ring 42, provides for an outer surface 104 of second ring 44 to be seated in an annular groove 106, FIG. 9, located in the center bore 26 of gearcase 20 without interference from first ring 42. The sizes of diameters 100 and 102 are such that diameter 100 contacts the surface of center bore 26 before diameter 102 contacts the outer diameter of annular groove 106.

Shoulder 110 is located at a forward section 108 of center bore 26. Viewing FIG. 9 in conjunction with FIG. 5, front surface 90 of propeller shaft housing 28 engages shoulder 110 when installed therein, as shown in FIG. 10. Outer edge 34 of propeller shaft housing 28 along with annular seal groove 92, FIG. 5, engage center bore 26, FIG. 9, of gearcase 20. This configuration effectively seals front section 108 of gearcase 20 from a rear section 112 of gearcase 20 through the application of a compressive load on propeller shaft housing 28. Included in rear section 112 of gearcase 20 is an exhaust passage 114. Exhaust passage 114 provides a path for exhaust gases to travel from the engine and through rear section 112 of gearcase 20. Annular groove 106 is located in rear section 112 of center bore 26 of lower gearcase 20. Annular groove 106 is configured to receive outer surface 104 of second ring 44 of retention ring assembly 40. Annular groove 106 prevents axial movement of retention ring assembly 40 in gearcase 20 which in turn prevents axial movement of the propeller shaft housing 28.

A cross-section of an assembled lower gearcase 20 is shown in FIG. 10. Drive shaft 116 extends vertically through gearcase 20 to a drive gear 118. Drive gear 118 transfers input power to propeller shaft 27. Front bearing 84 supports a reverse gear and rear bearing 86 supports propeller shaft 27 in gearcase 20. Seal 88 of propeller shaft housing 28 prevents fluid from entering front section 108 of gearcase 20 through propeller shaft housing 28. Front section 30 of propeller shaft housing 28, in conjunction with annular seal and seal groove 92, prevents fluid from entering front section 108 of gearcase 20 from rear section 112 of gearcase 20 at shoulder 110. Rear section 112 of gearcase 20 includes exhaust passage 114. Exhaust passage 114 provides a path for engine exhaust out of gearcase 20 at a location below a water line during operation of the engine. Propeller shaft housing 28 is retained in position by retention ring assembly 40.

Second ring 44 of retention ring assembly 40 is disposed in annular groove 106 of center bore 26 of gearcase 20. The fasteners 46 secure first ring 42 to second ring 44 of retention ring assembly 40. Tapered face 78 of first ring 42 engages tapered face 38 of propeller shaft housing 28 as the fasteners 46 are rotated in the direction that causes the rings to separate. The engagement of the tapered surfaces 38, 78 both concentrically center the propeller shaft housing 28 and secure propeller shaft housing 28 in gearcase 20 such that propeller shaft housing 28 is radially, rotationally, and axially fixed in relation to gearcase 20. The radial fixation is achieved by the snug fit created by tapers 38, 78 forced against one another by the ring assembly 40 and the rotational fixation is achieved by the frictional forces exerted on housing 28 by a clamping load exerted by the separation of the first and second rings 42, 44 via rotation of the screws 46. The axial fixation is achieved by the separation of the first and second rings 42, 44.

Therefore, in accordance with one aspect of the present invention, a retainer includes a first ring and a second ring. The first ring is constructed to expand radially outward. The second ring is removably connected to the first ring. A fastener system is independently connected to the first ring and the second ring.

The present invention also includes an outboard motor having a housing, an engine located in the housing, and a gearcase attached to the housing below the engine. A propeller shaft housing is positioned in the gearcase and supports a propeller shaft that extends therethrough. A retention ring assembly is situated in a rearward portion of the gearcase and abuts against the propeller shaft housing. The retention ring assembly is axially expandable to secure the propeller shaft housing in the gearcase.

The present invention also includes a gearcase having a center bore with a front end and a rear end. The gearcase has a shoulder in a perimeter of the front end of the center bore and an annular groove in the perimeter of the rear end of the center bore. A propeller shaft housing has a rear outer diameter positioned in the gearcase between the shoulder and the annular groove. A first C-shaped ring is engaged with the rear outer diameter of the propeller shaft housing. A second C-shaped ring is expandably secured to the first C-shaped ring and engaged with the annular groove of the gearcase.

The invention also includes a method of assembling a gearcase. The method includes attaching a first ring to a second ring via a plurality of screws to form a retention ring assembly. A propeller shaft housing is then inserted into a gearcase. The retention ring assembly is then compressed and inserted into the gearcase. The compression of the retention ring assembly is then released. The screws are then tightened to force the first ring away from the second ring and into engagement with the propeller shaft housing. The screws are preferably tightened a little at a time and in a cross-over pattern until fully tightened.

A retainer is also disclosed having a first and a second ring. The retainer includes a means for attaching the first ring to the second ring and expanding the first ring away from the second ring and having the attached rings radially expandable.

The present invention has been described in terms of the preferred embodiment, and it is recognized that equivalents, alternatives, and modifications, aside from those expressly stated, are possible and within the scope of the appending claims.

What is claimed is:

1. A retainer comprising:

a first ring constructed to expand radially outward;

a second ring removably connected to the first ring; and a plurality of threaded fasteners that connect the first ring to the second ring through a plurality of threaded holes in the first ring and the second ring.

2. The retainer of claim 1 wherein the plurality of threaded fasteners further comprise a first threaded section and a second threaded section, the first threaded section having a smaller diameter than that of the second threaded section.

3. The retainer of claim 1 wherein the retainer is longitudinally expandable.

4. The retainer of claim 1 wherein the first ring and the second ring have a plurality of collinear threaded holes and the threaded holes in the second ring are larger than the threaded holes in the first ring.

5. The retainer of claim 1 wherein the first ring and the second ring are snap-ring shaped and both rings are radially compressible.

6. The retainer of claim 1 wherein the first ring has a tapered face on an opposite side from the second ring and is constructed to center a propeller shaft housing.

7. The retainer of claim 1 wherein the plurality of threaded fasteners further comprises a first diameter and a second diameter and the second diameter is larger than a diameter of the threaded holes in the first ring.

8. The retainer of claim 2 wherein a thread pitch on the first threaded section is not the same as a thread pitch of the second threaded section.

9. An outboard motor comprising:

a housing;

an engine located in the housing;

a gearcase attached to the housing below the engine;

a propeller shaft housing positioned in the gearcase;

a propeller shaft extending through the gearcase and supported by the propeller shaft housing; and a retention ring assembly removably situated in a rearward portion of the gearcase and abutted against the propeller shaft housing, the retention ring constructed to axially expand.

10. The outboard motor of claim 9 wherein the retention ring assembly secures and centers the propeller shaft housing in the gearcase.

11. The outboard motor of claim 9, wherein the retention ring assembly further comprises a first ring and a second ring expandably secured together by a plurality of threaded fasteners.

12. The outboard motor of claim 11, wherein the first ring and the second ring include a plurality of threaded holes that are coaxial and wherein the threaded holes in the first ring have a diameter smaller than a diameter of the threaded holes in the second ring.

13. The outboard motor of claim 12 wherein the threaded holes in the first ring have a thread pitch that is finer than a thread pitch of the threaded holes in the second ring.

14. The outboard motor of claim 9, wherein the retention ring assembly further comprises a tapered front surface that corresponds to a tapered rear surface of the propeller shaft housing.

15. The outboard motor of claim 13 wherein the gearcase further comprises a shoulder therein that abuts a front face of the propeller shaft housing when inserted into the gearcase and wherein a ring groove has a thickness that corresponds to a thickness of the second ring of the retention ring assembly.

16. The outboard motor of claim 9 wherein the retention ring assembly includes a first split ring and a second split ring each having a plurality of coaxial threaded holes and the second split ring has two additional non-threaded holes.

17. The outboard motor of claim 9 wherein the retention ring assembly is radially expandable.

18. A gearcase comprising:

a center bore having a front end and a rear end;

a shoulder in the perimeter of the center bore at the front end;

an annular groove in the perimeter of the center bore at the rear end;

a propeller shaft housing positioned in the gearcase between the shoulder and the annular groove and having a rear outer diameter;

a first C-shaped ring engaged with the rear outer diameter of the propeller shaft housing; and a second C-shaped ring expandably secured to the first C-shaped ring and engaged with the annular groove of the center bore.

19. The gearcase of claim 18 wherein the first C-shaped ring is secured to the second C-shaped ring by a plurality of fasteners and aligned with an open portion of the second C-shaped ring.

20. The gearcase of claim 18, wherein the first C-shaped ring and the second C-shaped ring include a plurality of aligned threaded holes wherein the threaded holes of the second C-shaped ring have a larger diameter than a diameter of the threaded holes of the first C-shaped ring.

21. The gearcase of claim 18 wherein the first C-shaped ring further comprises a tapered face engaged with a tapered face of the propeller shaft housing.

22. The gearcase of claim 19 wherein the plurality of fasteners have a first threaded diameter that is smaller than a second threaded diameter.

23. The gearcase of claim 22 wherein first threaded diameter has a thread pitch that is not the same as a thread pitch of the second threaded diameter.

24. The gearcase of claim 18 incorporated into an outboard engine.

25. A method for assembling a gearcase comprising:

attaching a first ring to a second ring via a plurality of threaded fasteners to form a retention ring assembly;

inserting a propeller shaft housing into a gearcase;

compressing the retention ring assembly;

inserting the compressed retention ring assembly into the gearcase;

releasing the compression of the retention ring assembly; and tightening the plurality of threaded fasteners to force the first ring away from the second ring and into engagement with the propeller shaft housing.

26. The method of claim 25 wherein the step of releasing the compression of the retention ring assembly further comprises the step of seating the second ring in a snap-ring groove of the gearcase.

27. The method of claim 25 wherein the step of tightening the plurality of threaded fasteners further comprises the step of sequentially tightening each of the plurality of the threaded fasteners to centrally position the propeller shaft housing in the gearcase.

* * * * *